United States Patent [19]

Rosenberg et al.

[11] 3,956,123

[45] May 11, 1976

[54] ADDITIVE FOR ELECTRODEPOSITION OF BRIGHT TIN AND TIN-LEAD ALLOY

[75] Inventors: William E. Rosenberg, Strongsville; William E. Eckles, Cleveland Heights, both of Ohio

[73] Assignee: R. O. Hull & Company, Inc., Cleveland, Ohio

[22] Filed: Mar. 12, 1975

[21] Appl. No.: 557,798

Related U.S. Application Data

[62] Division of Ser. No. 443,406, Feb. 19, 1974.

[52] U.S. Cl. ..... 204/54 R; 204/DIG. 2; 204/43 S; 260/599

[51] Int. Cl.[2] ..... C25D 3/32; C25D 3/60

[58] Field of Search ..... 260/599; 204/DIG. 2, 204/54 R, 54 A, 43 S, 53, 45 R

[56] References Cited

OTHER PUBLICATIONS

Chemical Abstracts, Vol. 52, 17077e, (1958).

Chemical Abstracts, Vol. 72, 50345y, (1970).

*Primary Examiner*—G. L. Kaplan

*Attorney, Agent, or Firm*—Donnelly, Maky, Renner & Otto

[57] ABSTRACT

The invention disclosed herein relates to the electrolytic deposition of bright tin and tin-lead alloy. This invention is embodied in a new plating bath and a plating bath additive. The new plating bath includes tin or tin and lead ions, sulfuric acid or fluoboric acid, and the new additive. The new additive includes an emulsified naphthalene monocarboxaldehyde with or without a substituted olefin, having the general formula:

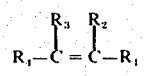

in which $R_1$ is carboxy, carboxamido, alkali carboxylate, ammonium carboxylate, amine carboxylate, or alkyl carboxylate, and $R_2$, $R_3$, and $R_4$ are hydrogen, methyl, or lower alkyl.

14 Claims, No Drawings

ADDITIVE FOR ELECTRODEPOSITION OF BRIGHT TIN AND TIN-LEAD ALLOY

BACKGROUND OF THE INVENTION

This application is a division of our earlier application Ser. No. 443,406, filed Feb. 19, 1974, now U.S. Pat. No. 3,875,029.

The invention pertains to aqueous acid plating baths and additives for producing semi-bright or bright electrodeposits of tin and tin-lead alloy.

Prior to this invention recently introduced commercially usable acid tin baths have been composed of multi-component brightening agents to produce acceptably bright electrodeposits. The essential ingredients of these baths are various combinations of certain aldehydes and ketones, imidazoline surfactants, nonionic surfactants, and amines. While these baths produce significantly bright deposits, many of them lack sufficient broad bright current density ranges. This means careful control of current and time consuming racking procedures are required to avoid dull or coarse deposits on parts that due to their irregular shapes promote uneven current distribution.

The one thing common to all of these combinations is that the ingredients depend on one another to produce bright deposits. Being essential ingredients the lack or absence of any one of them nullifies the effect of the others.

What makes our invention unique is that the naphthalene monocarboxaldehyde produces a brightness without dependence on distinct types of emulsifiers and amines. The only essential requirement is that the naphthalene monocarboxaldehyde be made soluble in the plating bath. This can be achieved by use of coupling agents as well as emulsifiers in general. Prior brightener systems require specific surfactants to be used since their brightening ability is essential in the performance of the system as a whole.

While it is true that the addition of compounds of the general formula:

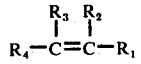

are required also for extreme luster, semi-bright to bright, uniform deposits can be obtained without them. Also with the use of this invention a very broad, bright current density range is achieved providing a means for electroplating extremely irregular shapes without stringent controls on current or racking of parts. In addition, higher current-densities can be achieved without obtaining coarse deposits, allowing an electroplater to obtain more plate thickness in a shorter time.

SUMMARY OF THE INVENTION

This invention is embodied in an aqueous acid electroplating bath containing a dissolved tin salt, together with a lead salt, if an alloy is desired, an acid selected from the group consisting of sulfuric acid and fluoboric acid and a solubilized or dissolved naphthalene monocarboxaldehyde.

When compounds of the general formula:

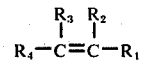

where $R_1$ is carboxy, carboxamido, alkali carboxylate, ammonium carboxylate, amine carboxylate, or alkyl carboxylate, and $R_2$, $R_3$, and $R_4$, are hydrogen, methyl, or lower alkyl are also added to the plating bath, they act synergistically with the naphthalene monocarboxaldehyde to give significantly brighter deposits than obtained with the dissolved naphthalene monocarboxaldehyde alone.

This invention is also a brightening agent for the aqueous acid electroplating baths described above comprised of about 1 to 99% naphthalene monocarboxaldehyde, about 0 to 99% emulsifier, 0 to 99% of a compound of the general formula:

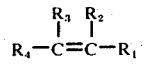

where $R_1$, $R_2$, $R_3$, and $R_4$ are defined as above, and the remaining percentage being a suitable solvent.

DESCRIPTION OF THE PREFERRED EMBODIMENTS

The aqueous acid electroplating baths of the present invention generally contain stannous ion, sulfate or fluoborate ions and dissolved naphthalene monocarboxaldehyde for proper operation. The stannous ion is introduced usually as stannous sulfate and the lead salt, when an alloy is desired, is introduced as lead fluoborate.

The naphthalene monocarboxaldehydes are readily available in commerce and their uniqueness as brightening agents compared to other aldehydes and ketones can be partially explained by a close study of their chemical structure.

Three resinance bond structures for naphthalene are possible, the symmetrical structure I and the two unsymmetrical, equivalent structures II and II*a*. In formulations of the unsymmetrical structures, one of the two rings is indicated as quinoid (q) because the arrangement of double bonds corresponds to that of o-benzoquinone.

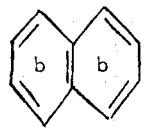

I

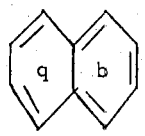

II

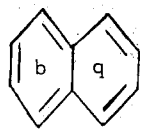

IIa

Various chemical reactions of naphthalene show that the bond structure of the naphthalene nucleus is not so mobile as that of benzene and that there is a relative fixation of bonds in at least part of the molecule at which substitution occurs. This is generally described as an enhanced 1,2-double bond character.

A much more detailed explanation of monosubstituted naphthalene's unique chemical behavior is given in "Advanced Organic Chemistry" by Fieser and Fieser, page 880. As can be concluded from the above discussion, monosubstituted binuclear aromatic aldehydes will show distinctly different chemical properties such as electron donating ability and reactivity when compared to aldehydes and ketones derived from benzene, heterocyclic aromatic single ring compounds, and certainly those of cyclic and straight chained aliphatic compounds.

The naphthalene monocarboxaldehyde is used at a concentration of about 0.05 to 0.5gms/liter and the preferred concentration is 0.2 gms/liter.

Due to its low solubility, coupling agents or emulsifying agents must be used to dissolve the naphthalene monocarboxaldehyde in the plating bath. Some of the suitable coupling agents are diethylene glycol monomethyl ether, diethylene glycol monobutylether, ethylene glycol monomethyl ether, and diethylene glycol monoethyl ether.

The emulsifying agents that have been found to work best are cationics such as the alkyl tertiary heterocyclic amines and alkyl imidazolinium salts, amphoterics such as the alkyl imidazoline carboxylates, and nonionics such as the aliphatic alcohol ethylene oxide condensates, sorbitan alkyl ester ethylene oxide condensates, and alkyl phenol ethylene oxide condensates. The nonionics are generally condensed with 10 to 20 moles of ethylene oxide per mole of lipophilic group. Listed in Table I are the commercial names and manufacturers of these emulsifiers. This invention is not limited to the use of these emulsifiers only, it being pointed out that this is merely a list of preferred types.

TABLE I

| Trade name | Type | Manufacturer |
|---|---|---|
| 1. Miranol HM | Amphoteric | Miranol Chemical Co. |
| 2. Miranol HS | Amphoteric | " " " |
| 3. Amine C | Cationic | Ciba-Geigy |
| 4. Amine S | Cationic | " " |
| 5. Tween 40 | Nonionic | ICI America |
| 6. Triton N-101 | Nonionic | Rohm & Haas Co. |
| 7. Tergitol TMN | Nonionic | Union Carbide |

The coupling agent concentration can be as low as about 3% by volume of the plating bath to as high as 20% by volume, 5% being the optimum. The emulsifier concentration will depend on its individual emulsifying ability, but a concentration of from about 1 to 10 gms. per liter of plating bath is generally sufficient.

An additional part of this invention is the combined brightening effect of naphthalene monocarboxaldehyde and compounds of the general formula:

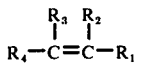

where $R_1$ is carboxy, carboxamido, alkali carboxylate, ammonium carboxylate, amine carboxylate, or alkyl carboxylate, and $R_2$, $R_3$, $R_4$ are hydrogen, methyl, or lower alkyl. The olefinic compound as set forth above may be added to a plating bath using the naphthalene monocarboxylate to obtain a much brighter deposit than can be obtained with the naphthalene monocarboxaldehyde alone. The olefinic compound has no brightening ability when used by itself, and acts as a brightener only when used in the above mentioned combination.

Examples of some of the preferred olefinic compounds are listed in Table II.

TABLE II

Acrylic Acid
Acrylamide
Methacrylamide
Methacrylic acid
Crotonic acid
Ethyl acrylate The required concentration of the olefinic compound is about 0.1 to 5 gms/liter, the preferred amount being 0.5 gms/liter. The required amount of the naphthalene monocarboxaldehyde in this synergistic combination is the same as when it is used alone.

Other known addition agents may be used in combination with the addition agents of this invention such as other aromatic and aliphatic aldehydes and ketones, but it has been generally found that they are not necessary. Antioxidants such as pyrocatechol and cresol sulfonic acids may be used with this invention as well as chelating agents to prevent metal sludge build up on anodes.

The brightening agents of this invention are generally added as aqueous, or methyl alcohol solutions, but other suitable solvents can be used as long as they don't cause detrimental results during electrodeposition. In some cases the addition agents may be added in their concentrated form, provided the plating bath is thoroughly stirred.

While the brightening agents of this invention are effective in many aqueous, acid tin plating bath formulations, it is preferred to use any of the basic baths described in the following examples. It will be understood that the following examples are just illustrations and are not meant to limit the use of the invention to these bath formulations only.

EXAMPLE I

| Bath Composition | Concentration in gms/liter |
|---|---|
| Stannous Sulfate | 30 |
| Sulfuric Acid | 200 |
| 1-naphthalene carboxaldehyde | 0.2 |
| diethyleneglycol monomethyl ether | 40 |

EXAMPLE II

| Bath Composition | Concentration in gms/liter |
|---|---|
| Stannous Sulfate | 45 |
| Sulfuric Acid | 150 |
| 2-naphthalene carboxaldehyde | 0.2 |
| Triton N-101 | 8 |

EXAMPLE III

| Bath Composition | Concentration in gms/liter |
|---|---|
| Stannous Sulfate | 20 |
| Sulfuric Acid | 200 |
| 1-naphthalene carboxyldehyde | 0.1 |

-continued

| Bath Composition | Concentration in gms/liter |
|---|---|
| Miranol HM | 4 |

EXAMPLE IV

| Bath Composition | Concentration in gms/liter |
|---|---|
| Stannous Sulfate | 30 |
| Sulfuric Acid | 200 |
| 2-naphthalene carboxaldehyde | 0.2 |
| Methacrylic acid | 0.5 |
| Triton N-101 | 8 |

EXAMPLE V

| Bath Composition | Concentration in gms/liter |
|---|---|
| Stannous Sulfate | 30 |
| Sulfuric Acid | 200 |
| 1-naphthalene carboxaldehyde | 0.2 |
| Acrylic acid | 0.4 |
| Triton N-101 | 10 |

EXAMPLE VI

| Bath Composition | Concentration in gms/liter |
|---|---|
| Lead Flouborate | 4.5 |
| Boric Acid | 10 |
| Tin Flouborate | 14 |
| Flouboric Acid | 90 |
| 2-naphthalene carboxaldehyde | 0.2 |
| Methacrylic acid | 0.5 |
| Tergitol TMN | 10 |

All testing was done in a conventional 267 ml. Hull Cell, using steel cathode panels and tin anodes. A current of two amperes was used for 5 minutes at temperatures ranging from 70°to 85°F. with mechanical agitation of the electrolyte. Table III indicates the type combinations run, the various basic baths used, and the results obtained.

the same, and having set forth the best mode contemplated of carrying out this invention, we state that the subject matter which we regard as being our invention is particularly pointed out and distinctly claimed in what is claimed, it being understood that equivalents or modifications of, or substitutions for, parts of the above specifically described imbodiment of the invention may be made without departing from the scope of the invention as set forth in what is claimed.

What we claim is:

1. A brightening agent for an aqueous acid tin electroplating bath consisting essentially of naphthalene monocarboxaldehyde and a coupling agent of an emulsifying agent selected from the class consisting of amphoteric or nonionic surfactants, or mixtures thereof, effective to solubilize the naphthalene monocarboxaldehyde in a plating bath.

2. The brightening agent of claim 1 wherein there is also present a suitable solvent which is inert in the plating bath.

3. The brightening agent of claim 1 wherein the naphthalene monocarboxaldehyde is 1-naphthalene carboxaldehyde.

4. The brightening agent of claim 1 wherein the naphthalene monocarboxaldehyde is 2-naphthalene carboxaldehyde.

5. The brightening agent of claim 1 wherein the emulsifying agent is an alkyl phenol condensed with about 10 to 20 moles of ethylene oxide per mole of alkyl phenol.

6. The brightening agent of claim 1 wherein the emulsifying agent is a compound obtained by the condensation of ethylene oxide with aliphatic alcohols, alkyl phenols or sorbitan alkyl esters.

7. The brightening agent of claim 6 wherein the emulsifying agent contains from about 10 to about 20 moles of ethylene oxide per mole of aliphatic alcohol, alkyl phenol or sorbitan alkyl ester.

8. The brightening agent of claim 1 wherein the coupling agent is selected from the group consisting of diethylene glycol monomethyl ether, diethylene glycol monobutylether, ethylene glycol monomethyl ether, and diethylene glycol monoethyl ether.

TABLE III

| Basic bath as described in examples but no addition agent, emulsifiers, or coupling agent | Position of aldehyde group on naphthalene ring | Olefinic compound | Emulsifier or coupling agent | Results |
|---|---|---|---|---|
| 1. Bath of Example I | 1 | — | Triton N-101 | Semi-bright to bright from 1 to 100 amps/ft.$^2$ |
| 2. Bath of Example I | 1 | Methacrylic acid | Miranol HM | Very bright from 1 to 80 amps/ft.$^2$ |
| 3. Bath of Example I | 2 | — | Amine C | Semi-bright from 1 to 80 amps/ft.$^2$ |
| 4. Bath of Example I | 1 | Acrylic Acid | Tween 40 | Very bright from 5 to 60 amps/ft.$^2$ |
| 5. Bath of Example I | 2 | Methacrylic Acid | Tergitol TMN | Very bright from 5 to 80 amps/ft.$^2$ |
| 6. Bath of Example VI | 1 | Methacrylamide | Triton N-101 | Very bright deposit from 10 to 80 amps/ft.$^2$ of an alloy composed of about 60% tin and 40% lead |
| 7. Bath of Example I | — | Acrylic Acid | — | Very dull at all current densities |
| 8. Bath of Example VI | — | Methacrylic acid | — | Very dull at all current densities |
| 9. Bath of Example I | 1 | — | diethyleneglycol monomethyl ether | Bright from 1 to 100 amps/ft.$^2$ |
| 10. Bath of Example II | 1 | Crotonic acid | Tergitol TMN | Bright from 10 to 100 amps/ft.$^2$ |

Having thus described this invention in such full, clear, concise and exact terms as to enable any person skilled in the art to which it pertains to make and use

9. A brightening agent for an aqueous acid tin electroplating bath consisting essentially of a. a naphthalene monocarboxaldehyde, b. at least one coupling agent or emulsifying agent effective to solubilize the naphthalene monocarboxaldehyde in a plating bath, c. an olefinic compound of the general formula:

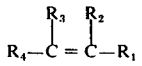

where $R_1$ is carboxy, carboxamido, alkali carboxylate, ammonium carboxylate, amine carboxylate, or alkyl carboxylate, and $R_2$, $R_3$, and $R_4$ are hydrogen, methyl, or lower alkyl, with or without d. a suitable solvent which is inert in the plating bath.

10. The brightening agent of claim 9 wherein $R_1$ is carboxy, $R_2$ is methyl, and $R_3$ and $R_4$ are hydrogen.

11. The brightening agent of claim 9 wherein $R_1$ is carboxy and $R_2$, $R_3$ and $R_4$ are hydrogen.

12. The brightening agent of claim 9 wherein the naphthalene monocarboxaldehyde is 1-naphthalene carboxaldehyde.

13. The brightening agent of claim 9 wherein the naphthalene monocarboxaldehyde is 2-naphthalene carboxaldehyde.

14. The brightening agent of claim 9 wherein the olefinic compound is an acrylic acid.

* * * * *